US009739086B2

(12) United States Patent
Chen

(10) Patent No.: US 9,739,086 B2
(45) Date of Patent: Aug. 22, 2017

(54) ARCHED WINDOW COVERING CAPABLE OF ADJUSTING SIZE

(71) Applicant: Nien Made Enterprise Co., Ltd., Taichung (TW)

(72) Inventor: Lin Chen, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 146 days.

(21) Appl. No.: 14/863,441

(22) Filed: Sep. 23, 2015

(65) Prior Publication Data

US 2016/0186486 A1 Jun. 30, 2016

Related U.S. Application Data

(63) Continuation-in-part of application No. 13/411,151, filed on Mar. 2, 2012, now Pat. No. 9,175,510.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/24*** | (2006.01) |
| ***E06B 9/38*** | (2006.01) |
| *E06B 9/262* | (2006.01) |

(52) U.S. Cl.
CPC ..... *E06B 9/24* (2013.01); *E06B 9/38* (2013.01); *E06B 2009/2488* (2013.01); *E06B 2009/2625* (2013.01)

(58) Field of Classification Search
CPC ..... E06B 2009/2488; E06B 9/262; E06B 2009/2482; E06B 2009/2625; E06B 9/38; A47H 1/18; A47H 2023/003; E04B 1/3205; E04B 1/32; E04B 2002/0282; E04B 2/42
USPC ..... 160/84.07, 134; 52/86, 88, 639
See application file for complete search history.

(56) References Cited

U.S. PATENT DOCUMENTS

| | | | | |
|---|---|---|---|---|
| 1,762,363 | A * | 6/1930 | Sergent | A01K 31/22 52/642 |
| 5,699,637 | A * | 12/1997 | Marocco | E06B 1/006 52/204.1 |
| 6,341,447 | B1 * | 1/2002 | Jean | E06B 7/082 160/84.07 |
| 7,048,027 | B1 * | 5/2006 | Abita | E06B 9/26 160/134 |
| 2005/0133168 | A1 * | 6/2005 | Hsu | E06B 9/32 160/84.07 |
| 2005/0183347 | A1 * | 8/2005 | Barry | B27D 1/083 52/86 |
| 2006/0090859 | A1 * | 5/2006 | Chhun | E06B 9/262 160/84.07 |

(Continued)

*Primary Examiner* — Katherine Mitchell
*Assistant Examiner* — Jeremy Ramsey
(74) *Attorney, Agent, or Firm* — Lynette Wylie; Apex Juris, pllc

(57) ABSTRACT

An arched window covering having shade mount with a base, at least a spacer, and two rails wherein a shade is mounted on the shade mount and the width of the spacer is adjustable and positioned on the base such that the rails movably engage the base and a length of the shade mount is changeable by changing the width of the spacer to thereby adapt to a differing size of a shade mounted on the shade mount by adjusting the spacer rather than cutting the rail to fit the windows with different sizes.

7 Claims, 16 Drawing Sheets

(56) References Cited

U.S. PATENT DOCUMENTS

2007/0284055 A1* 12/2007 Liang ..... E06B 9/262
160/84.07
2007/0284056 A1* 12/2007 Ying ..... E06B 9/262
160/84.07

* cited by examiner

ARCHED WINDOW COVERING CAPABLE OF ADJUSTING SIZE

CROSS-REFERENCE TO RELATED APPLICATIONS

This application is a continuation in part of U.S. patent application Ser. No. 13/411,151 titled "ARCHED WINDOW COVERING CAPABLE OF ADJUSTING SIZE", the subject matter of which is fully incorporated herein by reference.

BACKGROUND OF THE INVENTION

1. Field of the Invention

The present invention relates generally to a window covering, and more particularly to an arched window covering capable of adjusting the size thereof.

2. Description of the Related Art

Arched window coverings are designed for semi-circular windows. In early days, the arched window covering is simply a fan-shaped shade attached to the window by glue or double-sided adhesive tape. The shade usually is damaged when it is taken off from the window to wash or to replace. Nowadays, an improved arched window covering is provided, which includes a rail and a fan-shaped shade. The rail is mounted on the window, and the shade is detachably mounted on the rail without the damage problem when wash or replace. However, the sizes of the windows are variable, and the length of the rail must fit the window. The arched window covering with too short rail can't shade the entire window. Therefore, it has to prepare a rail longer than the usual window, and the rail is cut to fit the specific window when the worker installs the arched window covering on the window.

SUMMARY OF THE INVENTION

The primary objective of the present invention is to provide an arched window covering, which is able to adjust a size thereof to fit different windows.

According to the objective of the present invention, a shade mount of an arched window covering includes a base having an inserting portion and two connecting portions at opposite sides of the inserting portion; at least a spacer, which has two stop portions at opposite ends, connecting to the inserting portions of the base; and two rails movably connecting to the connecting portions and touching the stop portions of the spacer.

In an embodiment, the base further has a support portion, on which the spacer is provided, the inserting portion has an opening, which is separated into two sub-openings by the support portion, the spacer has the opposite ends inserted into the sub-openings and extending out of the base, and the rails have ends engaging the connecting portions of the base and the other ends extending outwards.

In an embodiment, the base has two case pieces, each of which has a protrusion, the protrusions of the case pieces are connected to form the support portion, a plurality of the spacers, which are arched plates with different lengths, are detachably stacked on the support portion, and the rails touch the stop portions of the longest spacer.

In an embodiment, the longest spacer has at least a protrusion on a bottom side, the shortest spacer has at least a slot on a top side, and the rest spacers have at least a protrusion and at least a slot on opposite sides to engage the neighboring spacers.

In an embodiment, the base has a hollow case, the inserting portion includes at least an opening on a top of the case and a plurality of slots on a bottom of the case, opposite ends of the spacers are inserted into the opening and engage the slots, the ends of the spacers extend out of the base, and the rails have ends engaging the connecting portions of the base and the other ends extending outwards.

In an embodiment, the base has two case pieces, each of which has a protrusion, the protrusions of the case pieces are connected to form the support portion, a plurality of the spacers, which are arched plates with different lengths, are detachably stacked on the support portion and engage the corresponding slots of the base.

In an embodiment, each of the spacers has at least a slot to engage the corresponding slot of the inserting portion.

In an embodiment, the spacer is a bendable plate, and the plate is bended to engage the specified slot of the inserting portion.

In an embodiment, the plate has a plurality of slots to engage the slots of the inserting portion.

In an embodiment, the shade mount further includes two boards connected to opposite of the base, wherein the spacer is between the boards In an embodiment, each board includes a first board formed on the base and a second board detachably connecting to the first board.

In an embodiment, the spacers are a plurality of arched plates with different lengths, and the inserting portion has two sets of slots to respectively engage opposite ends of the arched plates, and gaps are formed between the neighboring arched plates.

DETAILED DESCRIPTION OF THE INVENTION

Figure 1:
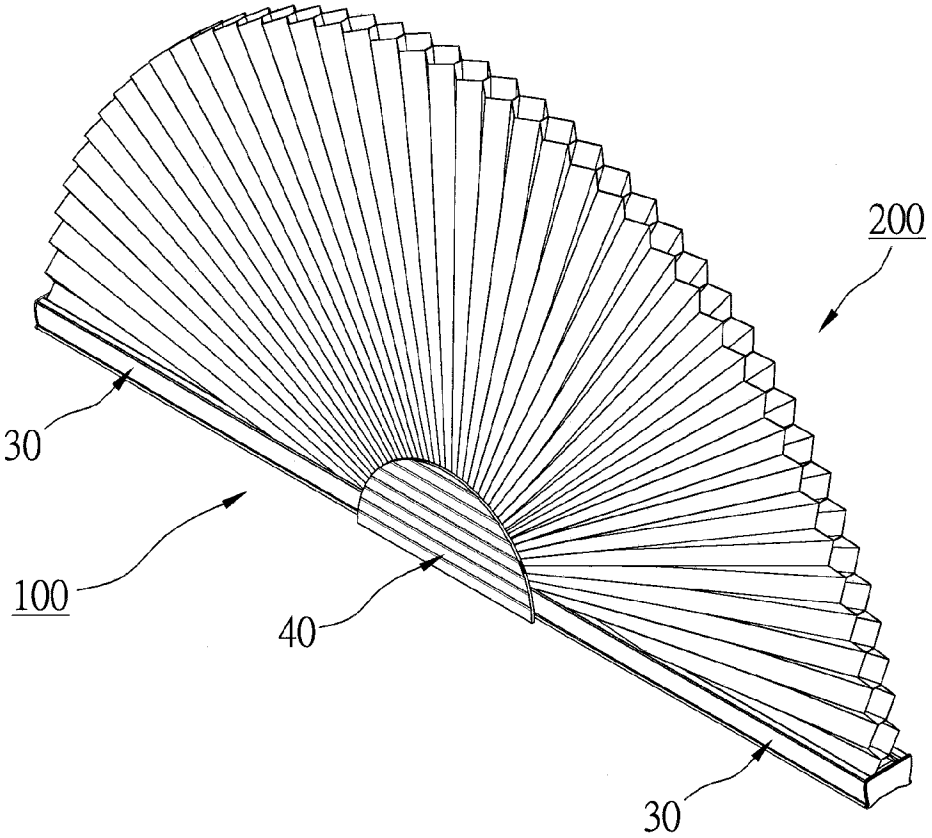
FIG. 1 and FIG. 2 are perspective views of a first preferred embodiment of the present invention, showing the shade mount and the shade.
Figure 2:
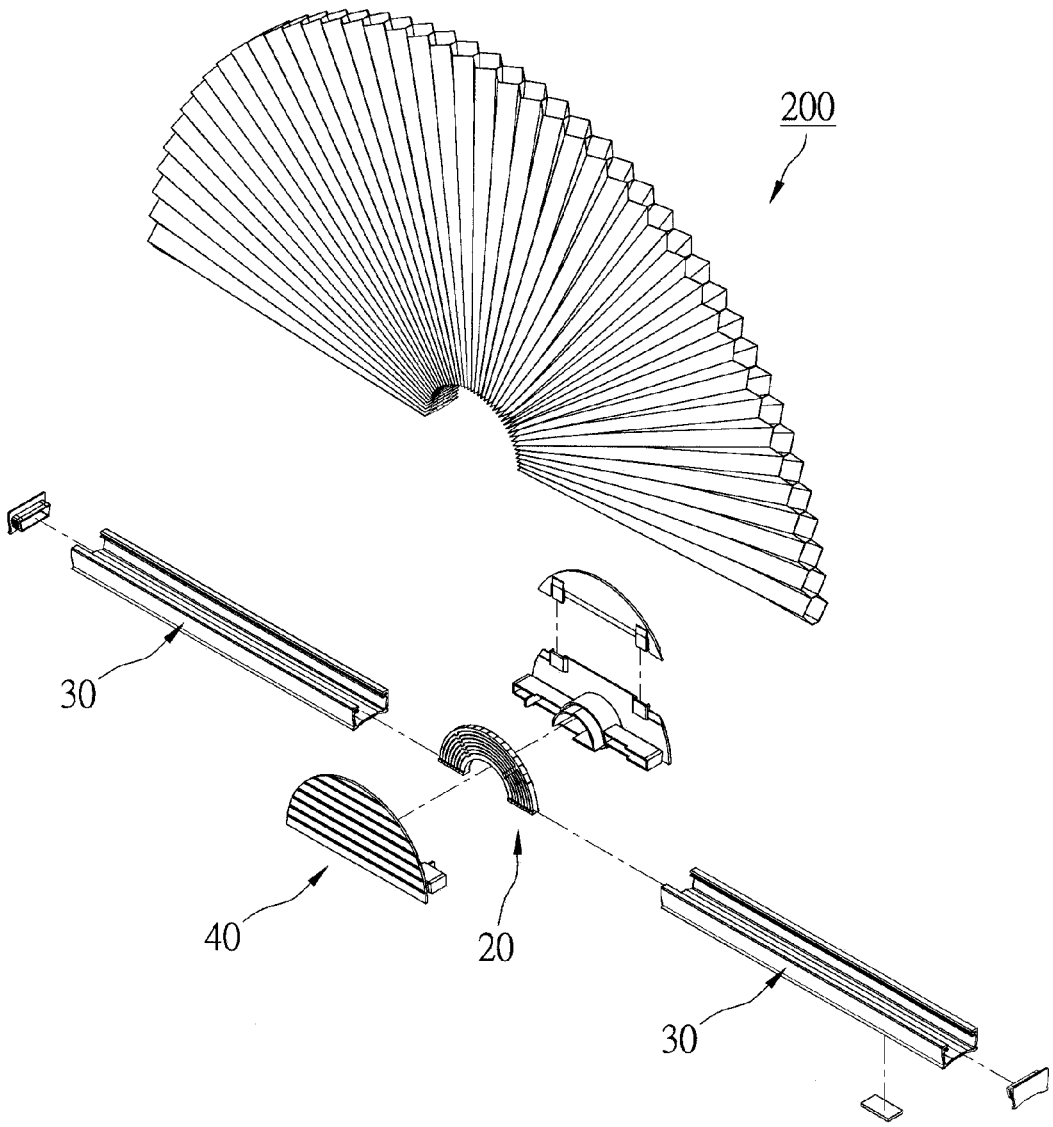

FIG. 1 and FIG. 2 show an arched window covering of the first preferred embodiment of the present invention, including a shade mount 100 and a fan-shaped shade 200. The shade 200 may be a honeycomb shade or a pleated shade. The present embodiment shows a honeycomb shade.

The shade 200 is detachably mounted on the shade mount 100. As shown in FIGs. from FIG. 3 to FIG. 6, the shade mount 100 includes a base 10, a plurality of arched plates 20, so called spacers, and two rails 30.

Figure 3:
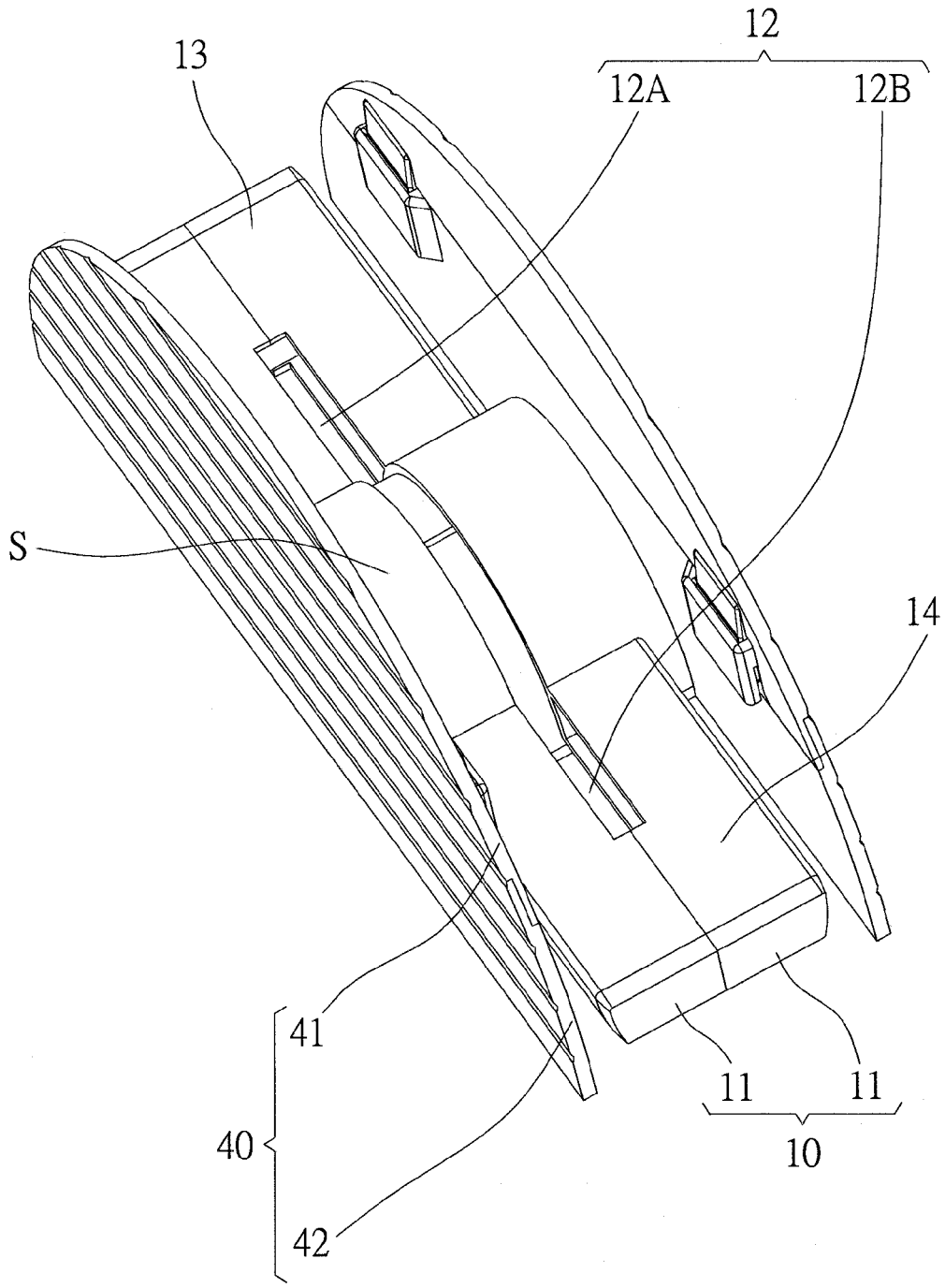
FIG. 3 is a perspective view of the first preferred embodiment of the present invention, showing the base of the shade mount.

The base 10 includes two case pieces 11 for abutted connection to form a hollow case with a vertical opening 12, so called inserting portion, at middle and two connecting portions 13, 14 at opposite sides. Each case piece 11 has two protrusions 11*a*, 11*b* for engagement. The engaged protrusions 11*a*, 11*b* form a semi-circular support portion S in the opening 12. As shown in FIG. 3, the support portion S connects the case pieces 11 and separate the opening 12 into two sub-openings 12A, 12B.

The arched plates 20 have different lengths, and the shortest arched plate 20 may be fully attached to the support portion S, and the rest arched plates 20 are stacked on it in an order from the shortest one to the longest one.

Each arched plate 20 (except the shortest one) is provided with protrusions 20*a* and slots 20*b* on opposite sides to engage the neighboring arched plate 20, and the arched plates 20 may easily disengage with each other as well. The shortest arched plate 20 only has the slots 20*b* on a top side. Therefore, the stack of the arched plates 20 has smooth bottom. The number of the arched plates 20 may change by removing the arched plate(s) 20 from the top of the stack.

Figure 6:
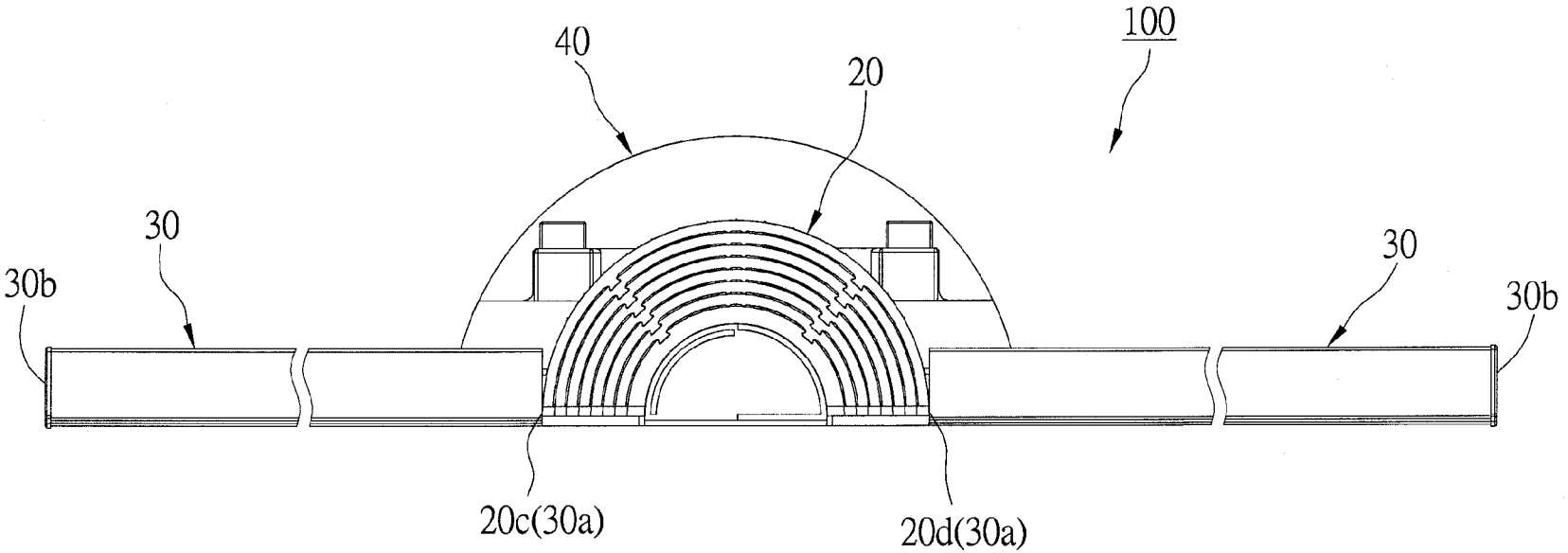
FIG. 6 is a front view of the first preferred embodiment of the present invention, showing the rails touching the arched plate.
Figure 7:
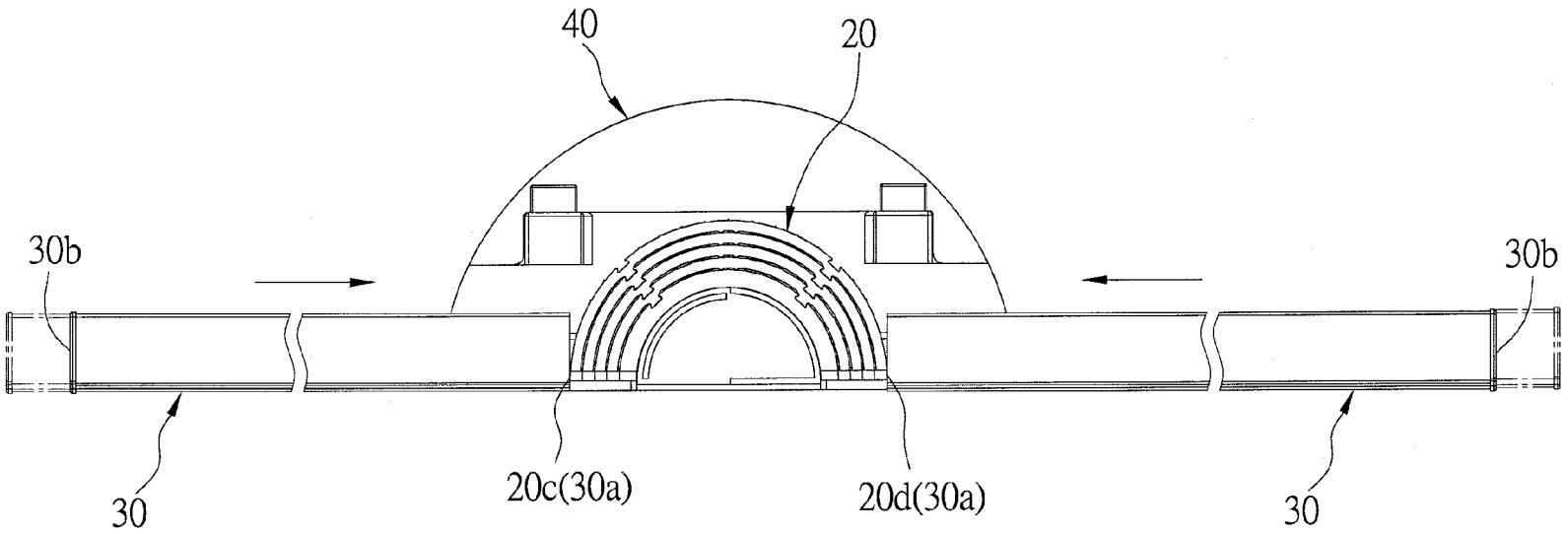
FIG. 7 is similar to FIG. 6, showing the distance between the rails being shortened by using less arched plates.

Each arched plate 20 has two stop portions 20*c*, 20*d* at opposite ends. The opposite ends of the arched plates 20 are inserted into the sub-openings 12A, 12B and extend out of the base 10. FIG. 6 shows eight arched plates 20 are stacked on the support portion S, and FIG. 7 shows six arched plates 20 are stacked on the support portion S. It is easy to tell that the overall diameter of the stack of eight arched plates 20 is wider than the stack of six arched plates 20. In other words, the maximum distance between the stop portions 20*c*, 20*d* (the distance between two proximal ends 30*a* of rails 30) in FIG. 7 is shorter than that in FIG. 6.

Figure 4:
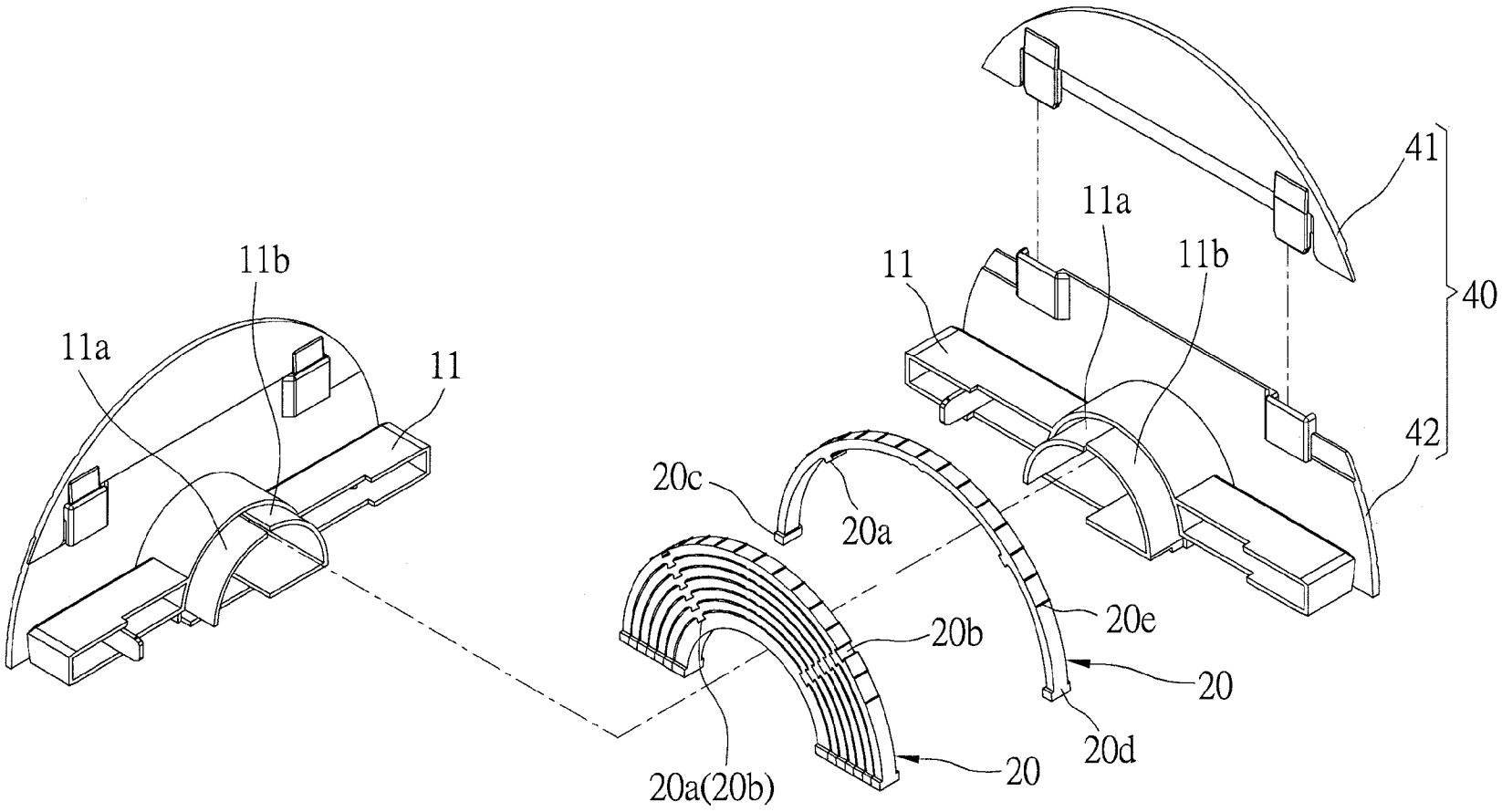
FIG. 4 is a perspective view of the first preferred embodiment of the present invention, showing the base and the arched plates of the shade mount.
Figure 5:
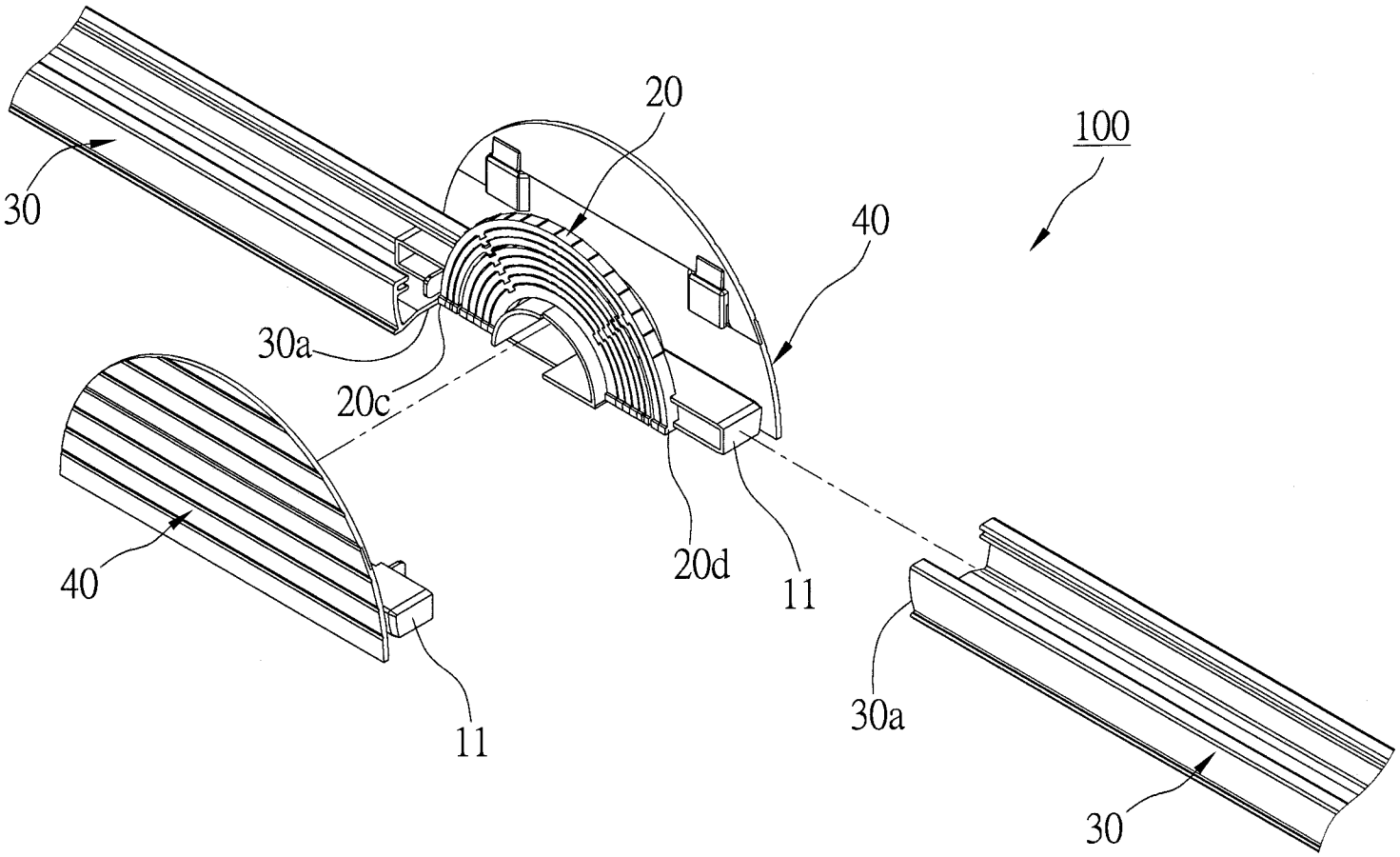
FIG. 5 is a perspective view of the first preferred embodiment of the present invention, showing the base, the spacer, and the rail of the shade mount.

Each arched plate 20 is provided with a plurality of shade slots 20*e* as shown in FIG. 4. The shade slots 20*e* are used to engage the shade 200.

Each rail 30 is an elongated member with a U-shaped cross-section. Proximal ends 30*a* of the rails 30 movably engage the connecting portions 13, 14 of the base 10 and touch the stop portions 20*c*, 20*d* of the arched plates 20, and distal ends 30*b* of the rails 30 extend in opposite directions. Consequently, a distance between the distal ends 30*b* of the rails 30 in FIG. 6 is longer than that in FIG. 7. It is easy to understand that we can change a length of the shade mount 100, the distance between the distal ends 30*b* of the rails 30, by adding or removing the arched plate(s) 20 rather than cutting the rail, and that will in turn increase or decrease the area of the shade 200 mounted on the shade mount 100 to fit the windows with different sizes.

As shown in FIG. 3 and FIG. 4, each case piece 11 is provided with a semi-circular board 40 at an outer side so that the arched plates 20 can hide behind the boards 40. The board 40 can include a first board 42 and a second board 41. The first board 42 can be inherently formed on the case piece 11, and the second board 41 detachably engages the first board 42 to form the semi-circular board 40.

Figure 8:
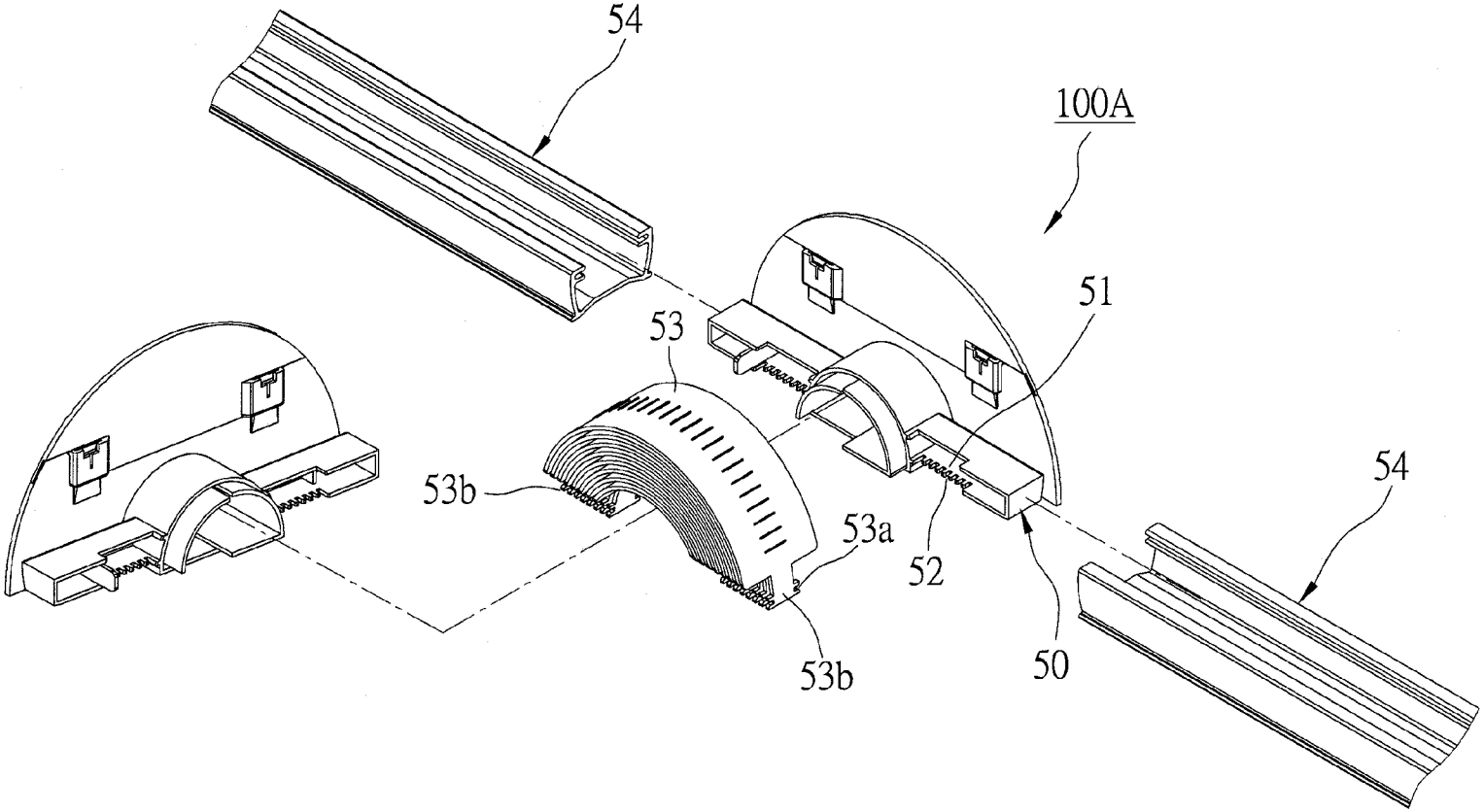
FIG. 8 is a perspective view of the shade mount of a second preferred embodiment of the present invention.

As shown in FIG. 8, a shade mount 100A of the second preferred embodiment of the present invention includes a base 50, a plurality of arched plates 53, so called spacers, and two rails 54. The base 50 consists of two case pieces to form a hollow case with an arched support portion at a center, and the rails 54 are two elongated members with U-shaped cross-sections.

Figure 9:
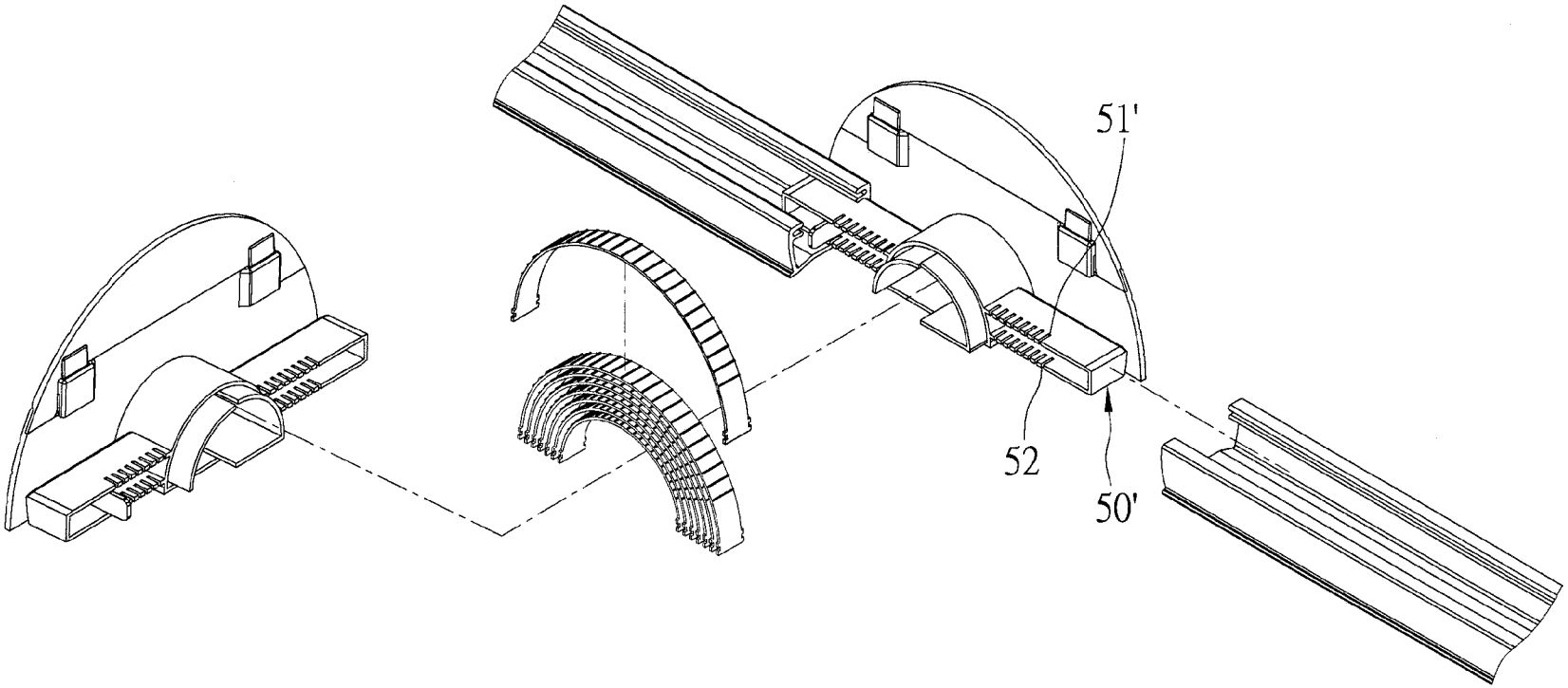
FIG. 9 is a perspective view of the shade mount of a third preferred embodiment of the present invention.

The base 50 has two inserting portions at opposite sides. Each inserting portion includes an opening 51 at a top of the base 50 and a plurality of parallel slots 52 on a bottom thereof. The arched plates 53 have different lengths to be stacked on the support portion in sequence. At each end of the arched plate 53 a stop portion 53*b* is formed. The stop portion 53*b* is a narrow piece to fit the openings 51. Two slots 53*a* are formed on opposite sides of the stop portion 53*b*. The stop portions 53*b* of each arched plate 53 are inserted into the openings 51 with the slots 53*a* engaging the corresponding slots 52 of the base 50. The same as the first preferred embodiment, the rails 54 connect to the connecting portions of the base 50 and touch the stop portions 53*b* of the arched plate 53. We can adjust the length of the shade mount 100A by adding or remove the arched plate(s) 53 to change the size of the shade. FIG. 9 shows a shade mount of the third preferred embodiment of the present invention, which is basically the same as the second preferred embodiment, except that a base 50' has corresponding slots 51' and 52 at a top and a bottom to engage each arched plates of different lengths.

Figure 10:
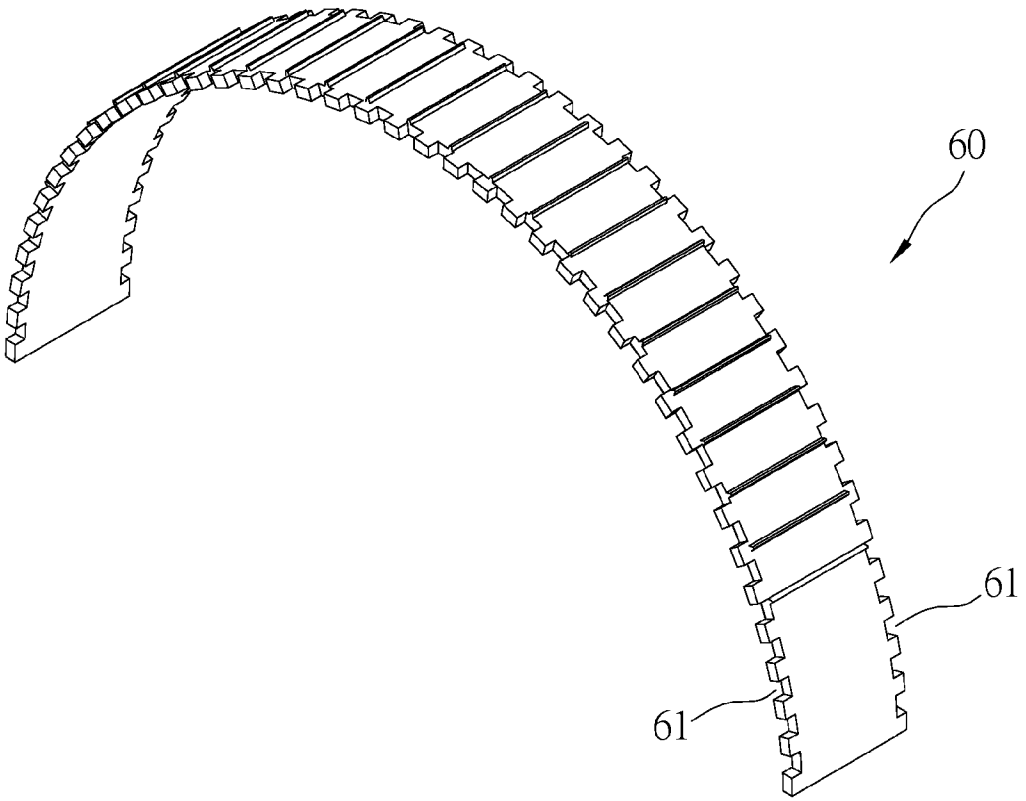
FIG. 10 is a perspective view of the arched plate of a fourth preferred embodiment of the present invention.
Figure 11:
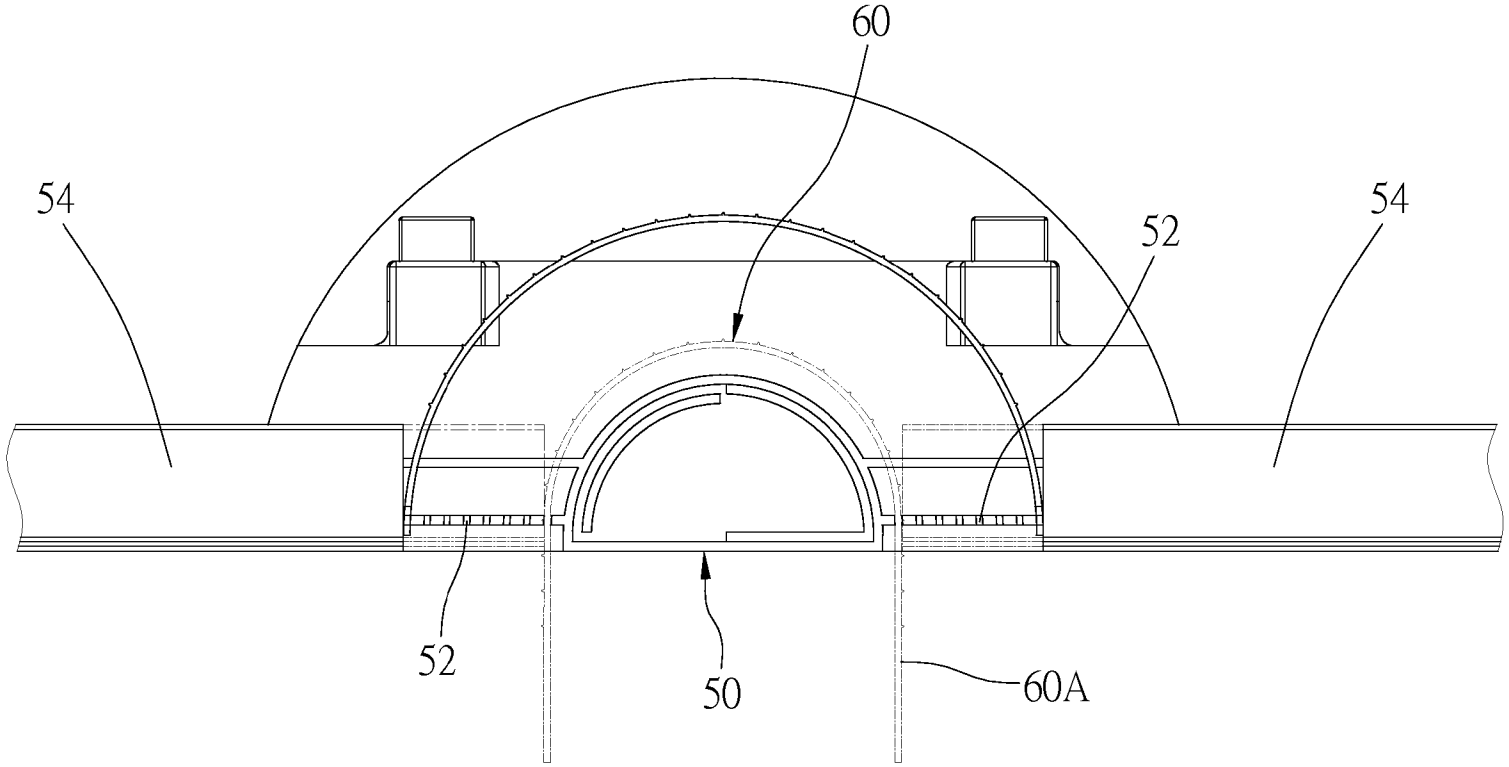
FIG. 11 is a front view of the fourth preferred embodiment of the present invention.

FIG. 10 shows a single flexible plate 60, the spacer, having a plurality of slots 61 along its longitudinally opposite sides. The plate 60 is bent to engage the slots 61 to the specified slots 52 on the base 50 of the shade mount 100A as shown in FIG. 8. As shown in FIG. 11, the plate 60 may be flexed to engage the slots 52 proximate to a center of the base 50, or may be extended to engage the slots 52 distal to the center of the base 50. The same as above, the rails connect to the base and touch the plate so that the length of the shade mount will decrease when the plate 60 engages the proximal slots 52, and will increase when the plate 60 engages the distal slots 52, and therefore, the size of the arched window covering changes, so as to fix different window sizes.

Figure 12:
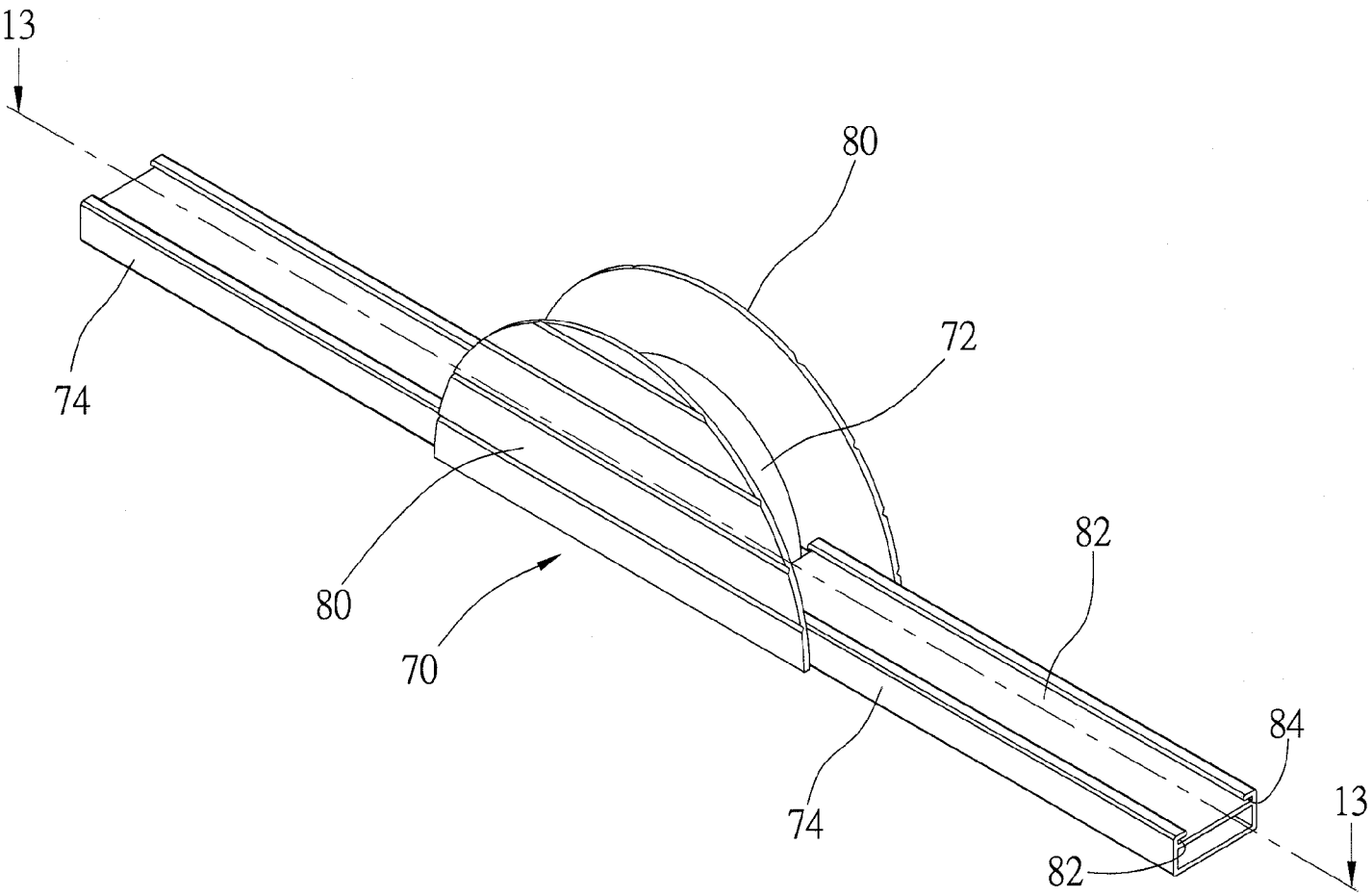
FIG. 12 is a perspective view of a fifth preferred embodiment of the present invention.
Figure 13:
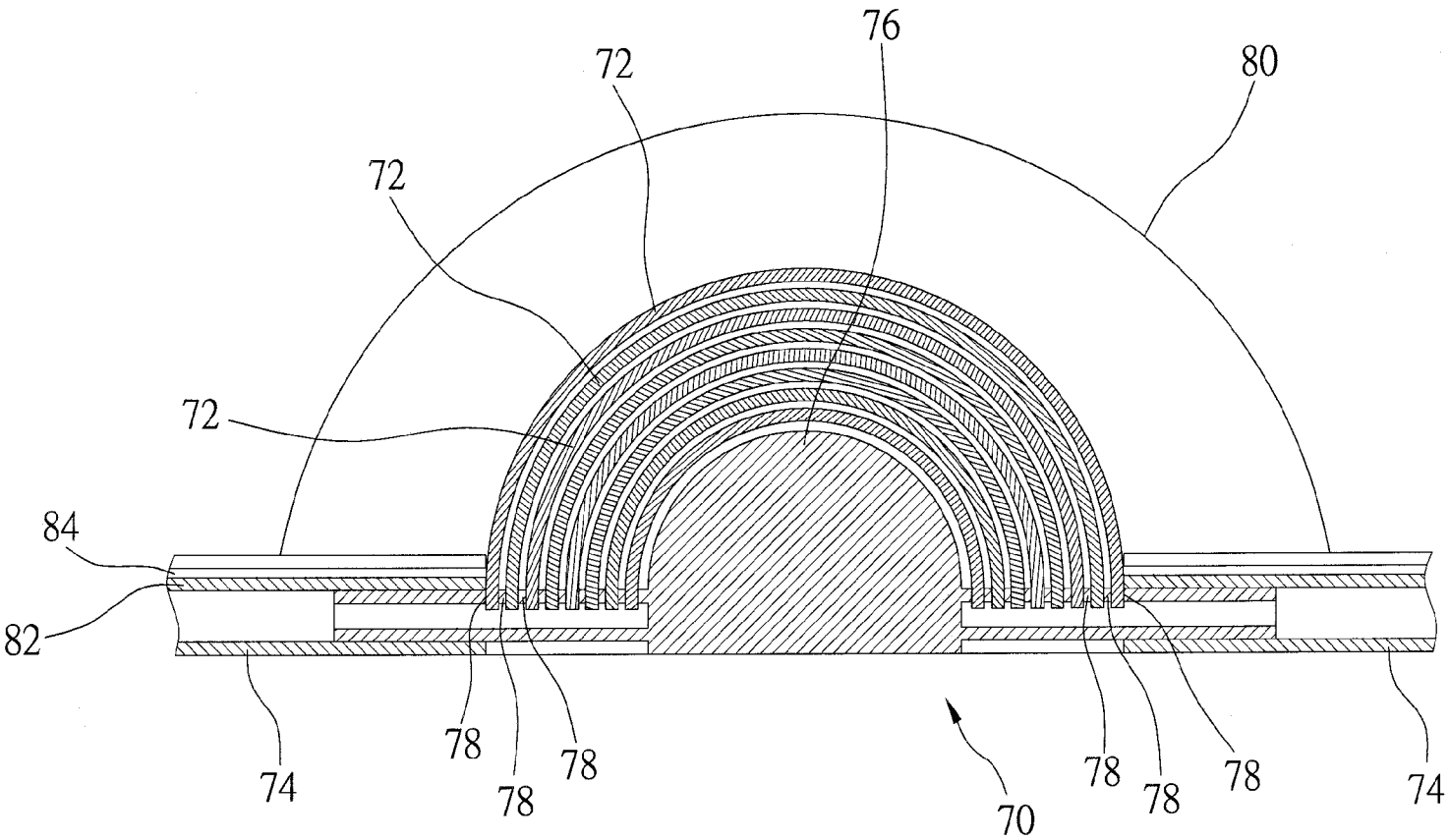
FIG. 13 is a sectional view along the 13-13 line of FIG. 12.

FIG. 12 shows a shade mount of the fifth preferred embodiment of the present invention, including a base 70, a plurality of arched plates 72, and two rails 74. The base 70 has a support portion 76 and an inserting portion to engage the arched plates 72. As shown in FIG. 13, the inserting portion includes two sets of slots 78 on a top of the base 70 and on opposite sides of the support portion 76 to respectively engage slots (not shown) of the arched plates 72 like above embodiments. Because of the restraint of the slots 78 the shortest arched plates 72 does not touch the support portion 76, and there are small gaps between the neighboring arched plates 72. The base 70 has no opening or slot on the bottom, and ends of the arched plates 72 are received in the base 70. The base 70 further has two one-piece boards 80 to hide the arched plates 74. The rail 74, comparing with the rail 30 shown in FIG. 2, has an extra wall 82 under a pair of engaging portions 84 which engage the fan-shaped shade (not shown), and the wall 82 will touch the longest arched plates 72. The function of the shade mount of the fifth preferred embodiment is the same as above.

Figure 14:
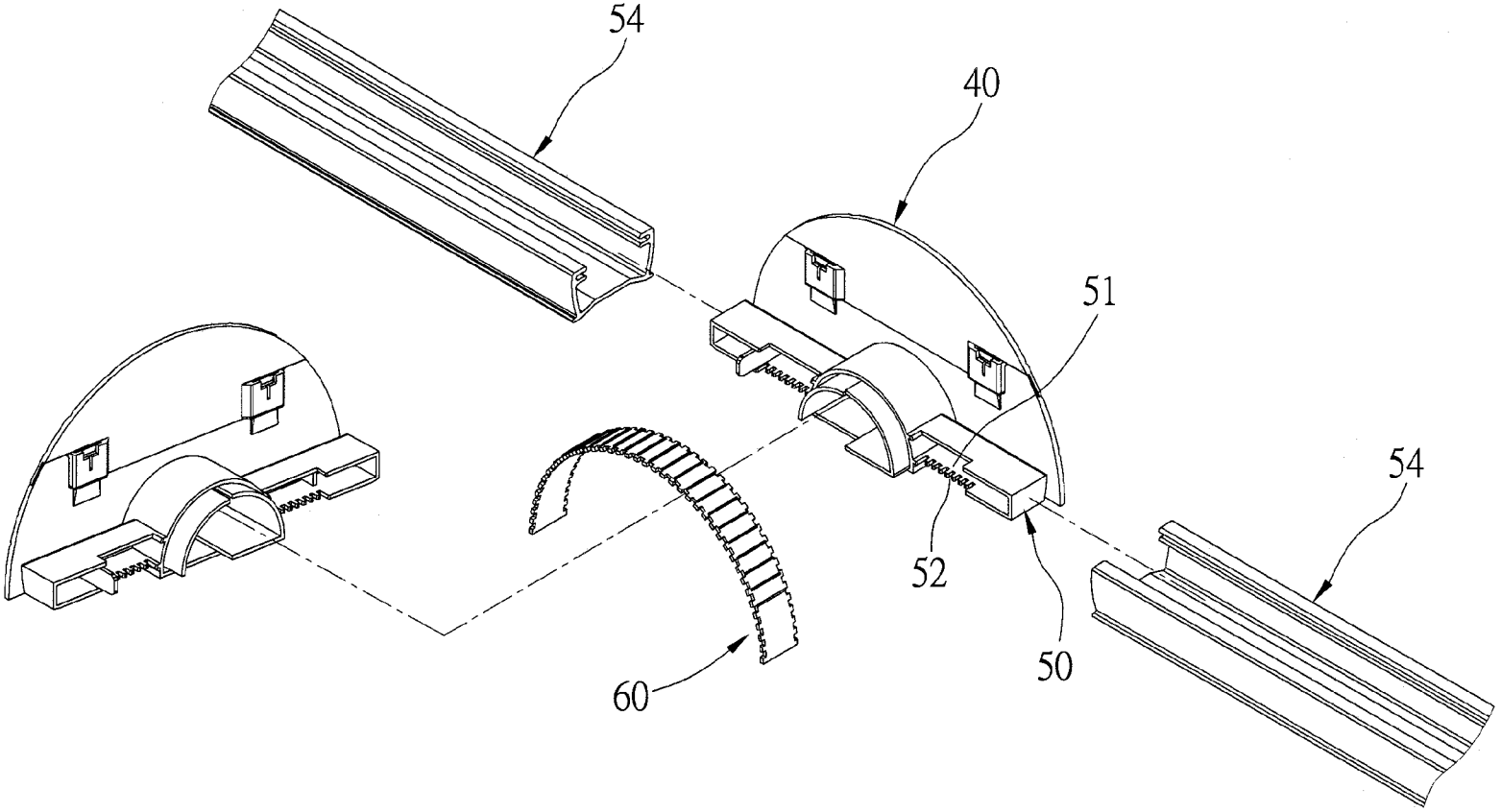
FIG. 14 is a perspective view of a sixth preferred embodiment of the present invention, showing a single spacer engaged with the base.

As mentioned above, the spacer illustrated in FIG. 10 is the single flexible plate 60, which has a plurality of slots 61 along its longitudinally opposite sides. In FIG. 14, the plate 60 is further disclosed to be engaged with the base 50 illustrated in FIG. 8. More specifically, the base 50 includes a top board 50*a* and a bottom board 50*b*, wherein the inserting portion of the base 50 includes the opening 51 provided on the top board 50*a*, and the plurality of slots 52 provided on the bottom board 50*b*. The plate 60 passes through the opening 51 with two ends thereof, and two of the slots 61 are engaged with two of the slots 52 of the bottom board 50*b*. In this way, the plate 60 is bent and engaged with the base 60. In other embodiments, the top board 50*a* can be omitted, as long as two of the slots 61 of the plate 60 can be respectively engaged with one of the slots 52 of the bottom board 50*b*.

The plate 60 depicted in solid lines in FIG. 11 engages the base 50 with two slots 61 located nearest to two ends of the plate 60 (i.e., the two endmost slots 61), wherein these two endmost slots 61 are respectively engaged into one of the two slots 52 of the base 50 which are also located nearest to lateral edges of the base 50 (i.e., the two endmost slots 52). In such case, the distance between two ends of the plate 60 is the longest, which consequently makes the space between the two rails 54 as the largest. On the other hand, the plate 60 depicted in dotted lines in FIG. 11 engages the base 50 with two slots 61, which are away from two ends of the plate 60, wherein these two slots 61 are respectively engaged into one of the two slots 52 which are located nearest to a center of the base 50 (i.e., the innermost two slots 52). The distance between two ends of the plate 60 can be adjusted accordingly between the endmost slots 52 and innermost slots 52, so that the space between the two rails 54 can be adjusted as a result. A portion 60A of the plate 60 may extend out of the base 50, and such portion 60A can be cut off. The aforementioned methods are all compatible to be applied for effectively changing the radius of the arched window covering.

Figure 15:
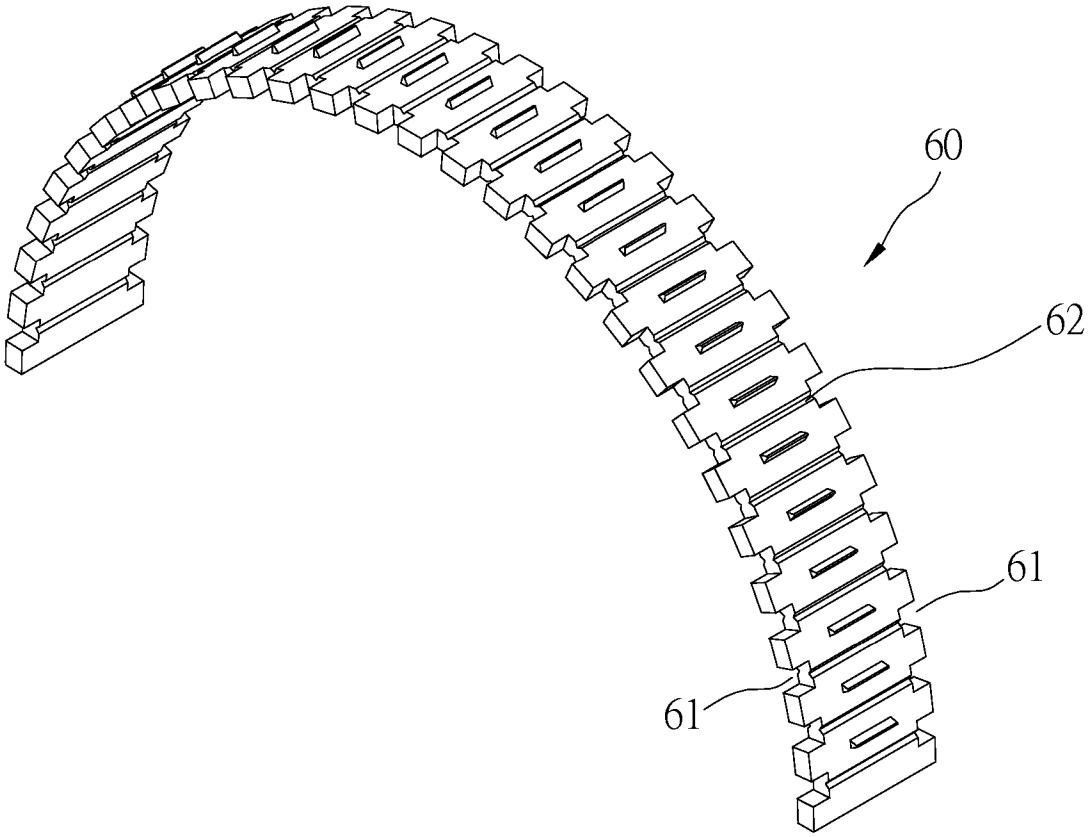
FIG. 15 is a perspective view of the arched plate of an alternative preferred embodiment of the present invention.

As shown in FIG. 15, in other embodiments, an inner or outside surface, or both inner and outside surface of the spacer can be further provided with a plurality of cutting slots 62, which are arranged parallel to a short axis direction of the spacer. With such design, when the spacer is engaged with the slots 52 of the base 50 on different demands, the portion 60A of the plate 60 which extends out of the base 50 can be directly snapped off without the need of using any tools.

Figure 16:
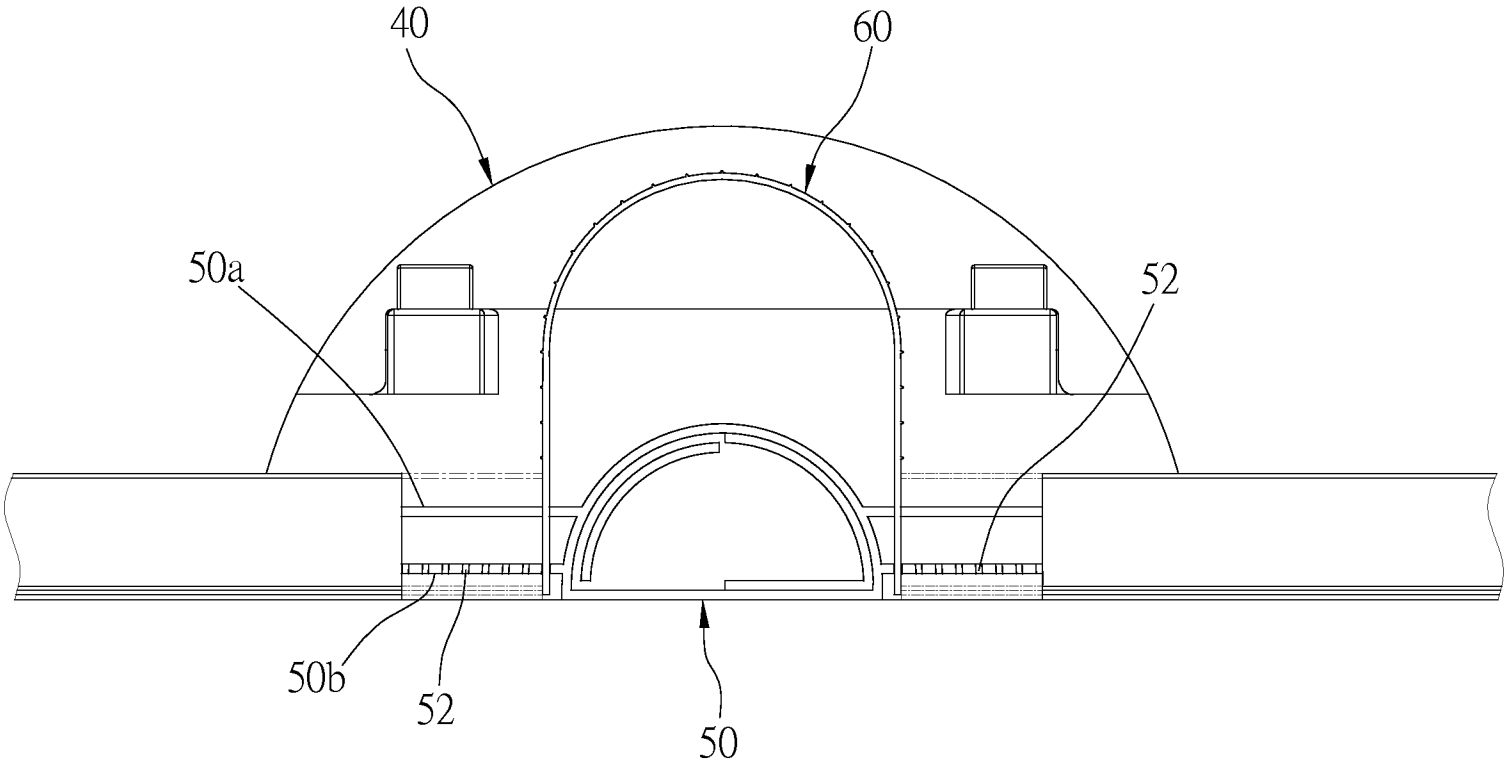
FIG. 16 is a front view of the sixth preferred embodiment of the present invention, showing two endmost slots of the single spacer are, similar to FIG. 11, respectively engaged with one of the two innermost slots of the base.

However, it's not always necessary to cut off or snap off any portion of the plate 60. As shown in FIG. 16, the two endmost slots 61 of the plate can be also engaged with the two innermost slots 52. Though the plate 60 is bent further in this situation, the whole plate 60 is still covered behind the boards 40. In other words, the intact plate 60 can be used as a single spacer to adjust the radius of the arched window covering as well.

The description above is only a few preferred embodiments of the present invention and the equivalence of the present invention is still in the scope of claim construction of the present invention.

What is claimed is:

1. A shade mount capable of adjusting a radius of an arched shade, comprising:

a base having a plurality of first slots;

a spacer in the form of a flexible plate having at least two second slots provided on at least one lateral long side thereof, wherein the at least two second slots engage with at least two of the plurality of first slots of the base to bend the spacer and thereby engage the spacer with the base; and two rails movably connected to two ends of the base respectively, wherein the two rails each adaptively engage a surface of the spacer to thereby adjust a length of the shade mount.

2. The shade mount of claim 1, wherein the base comprises an elongated bottom board, and the plurality of first slots of the base are provided on the bottom board; and wherein the at least two second slots of the spacer are respectively located at two ends of the spacer, wherein the two ends of the spacer extend out of the base when the at least two second slots of the spacer are engaged with the first slots of the base; and wherein an end of each of the two rails respectively abuts corresponding interfaces of the spacer and the base.

3. The shade mount of claim 2, wherein the at least two second slots of the spacer comprises a plurality of second slots, which are provided along a corresponding lateral long side of the spacer.

4. The shade mount of claim 1, wherein the base comprises a top board and a bottom board; the top board has an opening, and the plurality of first slots of the base are provided on the bottom board; the at least two second slots of the spacer are respectively located at two ends of the spacer, wherein the two ends of the spacer pass through the opening and extend out of the base when the at least two second slots of the spacer are engaged with the first slots of the base; an end of each of the two rails respectively abuts corresponding interfaces of the spacer and the base.

5. The shade mount of claim 4, wherein the at least two second slots of the spacer comprises a plurality of second slots, which are provided along a corresponding lateral long side of the spacer.

6. The shade mount of claim 1, wherein the spacer has a plurality of cutting slots provided on at least a surface thereof; the plurality of cutting slots are mutually parallel, and are arranged in a short axis direction of the spacer.

7. The shade mount of claim 1, further comprising two boards on opposite sides of the base, wherein the spacer is between the boards.

* * * * *